United States Patent [19]

Grossinger

[11] Patent Number: 4,678,317

[45] Date of Patent: Jul. 7, 1987

[54] CHARGE AND BIAS CONTROL SYSTEM FOR ELECTROPHOTOGRAPHIC COPIER

[75] Inventor: Israel Grossinger, Rehovot, Israel

[73] Assignee: Savin Corporation, Stamford, Conn.

[21] Appl. No.: 794,765

[22] Filed: Nov. 4, 1985

[51] Int. Cl.[4] ..... G03G 15/10

[52] U.S. Cl. ..... 355/14 D; 355/14 CH; 355/10; 118/648

[58] Field of Search ..... 355/14 CH, 3 CH, 14 D, 355/10; 118/648, 662

[56] References Cited

U.S. PATENT DOCUMENTS

| | | | |
|---|---|---|---|
| Re. 30,535 | 3/1981 | Kuroishi et al. | 355/10 |
| 3,892,481 | 7/1975 | Schaefer et al. | 355/14 D |
| 4,050,806 | 9/1977 | Miyakawa et al. | 355/14 D |
| 4,087,171 | 5/1978 | Yano | 355/14 D |
| 4,248,524 | 2/1981 | Takahashi | 355/14 D |

*Primary Examiner*—R. L. Moses

*Attorney, Agent, or Firm*—Shenier & O'Connor

[57] ABSTRACT

A charge and bias control system for a liquid-developer electrophotographic copier in which a sensing electrode is disposed in the developing station just upstream of the developing electrodes. Developer liquid fills the space between the sensing electrode and the photoconductor to provide a direct coupling between the two elements. The charge level is adjusted at the beginning of each copy cycle by supplying the control input for the charge-corona power supply with a ramp derived by periodically indexing a counter concurrently with the movement of the photoconductor. When the photoconductor surface potential, as measured by the sensing electrode, reaches a predetermined level, further indexing of the counter is inhibited. The same sensing electrode is used during the scanning phase of the copy cycle to regulate the biasing potential applied to the developing electrodes. Opposite-polarity cleaning potentials are applied to the developing electrodes between successive scans over respective time intervals which are staggered in accordance with the displacement of the developing electrodes along the path of movement of the photoconductor.

12 Claims, 8 Drawing Figures

CHARGE AND BIAS CONTROL SYSTEM FOR ELECTROPHOTOGRAPHIC COPIER

FIELD OF THE INVENTION

My invention relates to apparatus for controlling the charging of a photoconductive surface prior to exposure to form an electrostatic latent image of an original and for controlling the biasing potential thereafter applied to a developing electrode used to develop the latent image.

BACKGROUND OF THE INVENTION

Electrophotographic copiers are well known in the art. In copiers of this type, a photoconductive imaging surface, such as a selenium layer supported by a conductive cylindrical substrate, is first provided with a uniform electrostatic charge, typically by moving the surface at a uniform velocity past a charge corona. The imaging surface, which in the case of selenium now bears a positive potential of about 1,000 volts, is exposed to an optical image of an original to selectively discharge the surface in a pattern forming an electrostatic latent image. In the case of a typical original bearing dark print on a light background, this latent image consists of substantially undischarged "print" portions, corresponding to the graphic matter on the original, amidst a "background" portion that has been substantially discharged by exposure to light. The latent-image-bearing surface is then developed by oppositely charged pigmented toner particles, which deposit on the print portions of the latent image in a pattern corresponding to that of the original. In liquid-developer copiers, these particles are suspended in an insulating carrier liquid which is applied to the photoconductive surface.

One of the problems inherent in electrophotographic copiers has been the unwanted deposition of toner particles onto background portions of the latent image, which retain a background potential of about 100 volts even after exposure to light. One solution to this problem, as shown in Schaefer et al U.S. Pat. No. 3,892,481, Kuroishi et al U.S. Pat. No. 4,021,111, and Miyakawa et al U.S. Pat. No. 4,050,806, has been the disposition of a developing electrode in the developing station closely adjacent to the latent-image-bearing surface. The developing electrode is supplied with a biasing potential slightly above the residual potential of the background portions of the latent image, but well below the potential of the undischarged print portions of the image. Developer liquid is supplied to the region between the developing electrode and the photoconductive surface.

In such an arrangement, suspended toner particles in regions adjacent to the background portions are attracted to the developing electrode, which is more positive than the adjacent background portions of the latent image. At the same time, toner particles adjacent to the undischarged print portions of the latent image are attracted to these portions of the image, which are at a much higher potential than the developing electrode. In this manner, toner deposition on background portions of the image can be reduced or eliminated.

Although electrophotographic copiers of the type described above have proven successful in eliminating the problem of background staining, there remain areas for further improvement. Thus, while regulating the biasing potential adequately controls the density of the background portion of the developed image, it has little effect on the density of the print portions of the image.

It is also known in the art to use an electrometer to control the rate at which a photoconductive surface is charged. Such systems are disclosed, for example, in Weber U.S. Pat. No. 4,431,302, Fantozzi U.S. Pat. No. 4,341,461, and Tabuchi U.S. Pat. No. 4,432,634. Each of these systems, however, has one or more drawbacks. Thus, the Weber system is concerned with the control of charge level only, and would require an entirely independent system to control the density of the background portions of the developed image. Tabuchi is concerned primarily with maintaining a constant difference between the charge potential and the biasing potential (column 4, lines 7 to 18; Claim 1, column 8, lines 8 to 14). Tabuchi does not suggest, nor would the disclosed system be readily adaptable to, independent control of the charge potential and the biasing potential. Likewise, in Fantozzi, substantially independent systems are used for control of charging and biasing potential, increasing the overall cost and complexity of the system. Moreover, in all three of these disclosures, the electrometer operates through an air gap, creating inevitable inaccuracies of measurement.

Still other problems inherent in systems of the prior art relate to the bias control system itself. As disclosed in the above-identified Schaefer et al and Kuroishi et al patents, it is known in the art to supply the development electrode with an opposite-polarity cleaning potential between successive copies. This cleaning potential repels accumulated toner particles from the development electrode onto the photoconductive surface, from which the toner particles are eventually removed at a cleaning station. In this manner, one avoids the buildup of toner particles on the development electrode, which would impair operation. Such a cleaning cycle, however, imposes an upper limit on the copy rate. Thus, if the development electrode extends a distance L1 along the path of the photoconductor, and the photoconductor itself moves a distance L2 during the application of a cleaning potential to the development electrode, the total extent of the photoconductor surface used to remove toner particles from the development electrode is L1+L2. This extent of the photoconductive surface is unavailable for the formation of a latent image of a successive original, and necessitates a minimum interval between copies.

SUMMARY OF THE INVENTION

One object of my invention is to provide an apparatus which regulates the charging potential of a photoconductive surface.

Another object of my invention is to provide an apparatus which accurately measures the potential of a charged photoconductive surface.

A further object of my invention is to provide an apparatus which prevents toner accumulation on the development electrode of an electrophotographic copier.

Still another object of my invention is to provide an electrophotographic copier having a relatively high copy rate.

An additional object of my invention is to provide an apparatus for regulating the charging and bias potentials of an electrophotographic copier which is relatively simple and inexpensive.

Other and further objects will be apparent from the following description:

One aspect of my invention contemplates a charge and bias control system for an electrophotographic copier in which the same electrode responsive to the photoconductor potential is used to control both the corona charger and the bias supply coupled to the developing electrode. Preferably, the sensing electrode is disposed between the exposure station and the developing electrode. The sensing electrode is preferably sampled during the passage of a fully charged, but unexposed portion of the photoconductor to provide a signal for controlling the charge corona, and is sampled during the passage of an exposed portion of the photoconductor to provide a signal for controlling the bias supply.

Another aspect of my invention contemplates a charge control system in a liquid-developer copier in which a sensing electrode used to control the charge corona is so positioned relative to the photoconductor that developer liquid fills the space between the electrode and the photoconductor to provide a direct coupling between the two elements.

In accordance with another aspect of my invention, the charge level is adjusted, as at the beginning of each copy cycle, by supplying the control input of the charge-corona power supply with a ramp, preferably derived by periodically indexing a counter concurrently with the movement of the photoconductor. When the photoconductor surface potential, as measured by the sensing electrode, reaches a predetermined level, further generation of the ramp is inhibited.

In accordance with yet another aspect of my invention, opposite-polarity cleaning potentials are applied to the developing electrodes between successive scans over respective time intervals which are staggered in accordance with the displacement of the developing electrodes along the path of movement of the photoconductor.

BRIEF DESCRIPTION OF THE DRAWINGS

In the accompanying drawings to which reference is made in the instant specification and in which like numbers are used to indicate like parts in the various views.

DESCRIPTION OF THE PREFERRED EMBODIMENT

Figure 1:
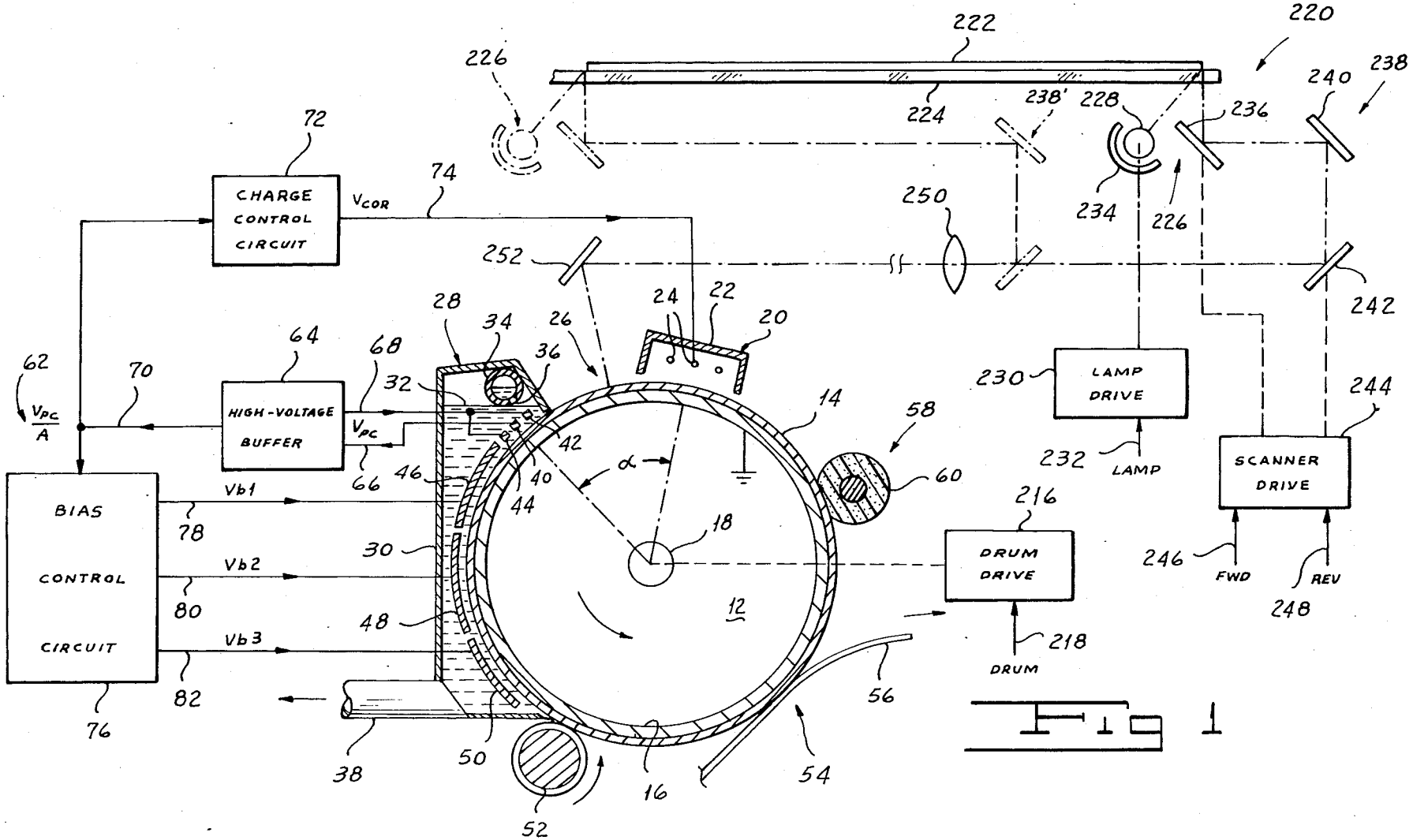
FIG. 1 is a fragmentary front elevation, with parts shown in section, of an electrophotographic copier incorporationg my charge and bias control system.

Referring now to FIG. 1, an electrophotographic copier, indicated generally by the reference numeral 10, incorporating my charge and bias control system includes a photoconductive imaging drum 12 having a peripheral photoconductor 14, formed of selenium and supported by a grounded conductive substrate 16. Stub shafts 18 support the drum 12 for rotation on a horizontal axis. In a manner well known in the art, drum 12 is rotated by a drum drive 216 first past a charge corona, indicated generally by the reference numeral 20, which provides the photoconductor 14 with a uniform positive electrostatic charge. Charge corona 20 comprises a conductive shield 22, which is preferably grounded, and one or more transversely extending corona wires 24. The charged portion of the photoconductor 14 then moves through an exposure station indicated generally by the reference numeral 26. There, the surface 14 is exposed to a flowing optical image of an original document 222, produced by an optical scanning system 220 to be described, to discharge the surface selectively in a pattern corresponding to the graphic matter on the document.

Upon emerging from the exposure station 26, the photoconductor 14, which now bears an electrostatic latent image of the document 222, moves through a developing station indicated generally by the reference numeral 28, located on the side of the drum 12. A more detailed description of the developing station 28 may be found in the copending application of Benzion Landa et al, Ser. No. 628,462, filed July 6, 1984, entitled "Multiple Color Liquid Developer Electrophotographic Copying Machine and Liquid Distribution System Therefor". In the developing station 28, a tank 30 is formed with walls that cooperate with the adjacent portion of the drum 12 to confine a quantity of developer liquid 32 in the tank 30 with minimal leakage between the tank walls and the drum 12. Developer liquid 32 comprises a suitable insulating carrier liquid, such as the one sold by Exxon Corporation under the trademark ISOPAR G, containing suspended, negatively charged toner particles (not separately shown). A developer supply system (not shown) supplies the developer liquid 32 to a distributor 34 which extends across the drum surface 14 and is provided with orifices 36 at regularly spaced locations along its length. The developer liquid 32 returns to the supply (not shown) by way of an outlet 38 leading from the bottom of the tank 30.

Upon entering the developing station 28 defined by the tank 30, the drum photoconductor 14 passes a sensor electrode 40. Sensor electrode 40, which is spaced slightly from photoconductor 14, is used to measure the potential of the surface of the photoconductor to provide suitable signals for controlling the charging and development in a manner to be described. Immediately upstream and downstream of the sensor electrode 40 are guard electrodes 42 and 44, which are supplied with a potential equal to that of the sensor electrode 40, in manner to be described, to shield the sensor electrode from extraneous electrostatic influences. As shown in FIG. 1, the developer liquid 32 completely fills the gap between the sensor electrode 40 and the adjacent portion of the photoconductor surface 14. The developer liquid 32 has a relatively high resistance, on the order of $10^9$ ohms, as seen by the sensor electrode 40. Nevertheless, this resistance is sufficiently low, compared with the input resistance of the control circuit to be described, that the liquid 32 effectively provides a conductive path between the surface of the photoconductor 14 and the electrode 40. In this manner, measurement inaccuracies inherent in electrometers of the prior art, which typically operate through an air gap, are reduced or eliminated.

After passing the sensor electrode 40 and guard electrodes 42 and 44, the latent-image-bearing surface 14 passes developing electrodes 46, 48 and 50, which are disposed inside the developing tank 30 at a slight spacing from the drum surface 14, at successive locations along the drum periphery. In the embodiment shown in FIG. 1, each of the electrodes 46, 48 and 50 subtends an angle of about 30° relative to the axis of the drum 12. Each of the electrodes 46 to 50 is biased in a manner to be described at a potential greater than that of the background portions of the latent image drum surface 14, but less than that of the print portions of the image corresponding to printed matter on document 222. Toner particles are thus attracted only to the print portions of the image, and do not deposit on the background portions to cause background staining.

Upon emerging from the developing station 28, drum surface 14, which now bears a developed toner image of the graphic matter on document 222, moves past a metering roller 52. Metering roller 52, disposed closely adjacent to the drum surface 14, is driven at high speed in the same rotary direction as drum 12 to remove excess developer liquid from the surface 14. The image-bearing surface 14 then moves through a transfer station indicated generally by the reference numeral 54. In the transfer station 54, a carrier sheet 56, preferably a sheet of plain paper, is brought into close adjacency with the drum surface 14 for transfer of the developed image from the surface 14 to the sheet of paper 56. Preferably, a transfer corona (not shown), disposed on the other side of the sheet 56 from the drum 12, is used to supply the sheet with an electrostatic charge of such polarity as to attract toner particles from the drum surface 14.

After receiving the developed image from the drum 12, the sheet 56 is separated from the drum by any suitable means (not shown) and directed to a fuser station (not shown) or other subsequent processing station. Upon emerging from the transfer station 54, the photoconductive drum surface 14 moves through a cleaning station, indicated generally by the reference numeral 58, in which a wetted cleaning roller 60 scrubs the drum surface to remove any remaining toner particles. When it emerges from the cleaning station 58, the drum surface 14 returns to the charge corona 20, for another cycle similar to the one just described if additional copies are to be made. Preferably, an erase corona (not shown) is disposed between the cleaning roller 56 and the charge corona 20 and is suplied with a high-voltage AC potential to neutralize any residual electrostatic charge that may remain on the drum surface 14.

The optical scanning system of the copier 10, indicated generally by the reference numeral 220, includes a first, or full-rate, scanning carriage indicated generally by the reference numeral 226. Full-rate carriage 226 supports an elongated exposure lamp 228, which directs light onto an original document 222 placed upon a transparent exposure platen 224, and a mirror 236 arranged to receive light reflected from the illuminated portion of the document 222. An elliptical reflector 234 focuses a narrow strip of light from the lamp 228 onto a transversely extending strip of the document 222. A lamp drive 230 intermittently actuates lamp 228 in a mannor to be described in response to a LAMP signal supplied on a line 232.

A second, or half-rate, scanning carriage indicated generally by the reference numeral 238 supports an upper mirror 240 and a lower mirror 242. Mirror 236 of the full-rate carriage 226 reflects light from the document 222 to upper mirror 240 of the half-rate carriage 238 along a path segment parallel to the imaging platen 224. Mirror 240 reflects the light downwardly onto the lower mirror 242, which reflects the light along the optical axis of a lens 250 which is parallel to platen 224. A stationary mirror 252 disposed on the other side of lens 250 from mirror 242 reflects the light downwardly onto the portion of the photoconductor 14 passing through the exposure station 26.

A document 222 placed upon the platen 224 is scanned by supplying drum drive 216 with a DRUM signal on line 218 to rotate the drum 12 counterclockwise as viewed in FIG. 1 at a predetermined surface speed. Simultaneously, a FWD signal is applied on a line 246 to a scanner drive 244 to move the full-rate scanning carriage 226 at the same speed from the position shown in solid lines in FIG. 1 to a displaced position 226' shown in phantom lines in the same figure. Simultaneously with the movement of drum 12 and full-rate carriage 226, scanner drive 244 moves half-rate carriage 238 in the same direction as full-rate carriage 226, but at half the speed, between the position shown in solid lines in FIG. 1 and the position 238' shown in phantom lines in the same figure, to maintain a constant optical path length between document 222 and photoconductor 14. At the end of the forward scanning stroke, a REV signal is applied on a line 248 to scanner drive 244 to return scanning carriages 226 and 238 to their original positions in preparation for another scanning cycle.

While unnecessary for an understanding of my invention, a more detailed description of the scanning system 220 may be found in the co-pending application of Benzion Landa et al, Ser. No. 628,239, filed July 6, 1984, entitled "Optical Scanning System for Variable-Magnification Copier", as well as in the co-pending application of Benzion Landa et al, Ser. No. 628,233, filed July 6, 1984, entitled "Lens and Shutter Positioning Mechanism for Variable-Magnification Copier".

The charge and bias control system, indicated generally by the reference character 62, includes a high-voltage buffer 64 to be described in more detail below. An input line 66 supplies buffer 64 with a signal Vpc from sensor electrode 40, representing the surface potential of photoconductor 14. An output line 68 from the buffer 64 supplies the same potential to guard electrodes 42 and 44. Buffer 64 provides an output signal Vpc/A on line 70 to a charge control circuit 72 as well as to a bias control circuit 76. Charge control circuit 72, to be described in more detail below, provides electrodes 46, 48 and 50 with respective biasing potentials Vb1, Vb2 and Vb3 on respective output lines 78, 80 and 82.

Figure 2:
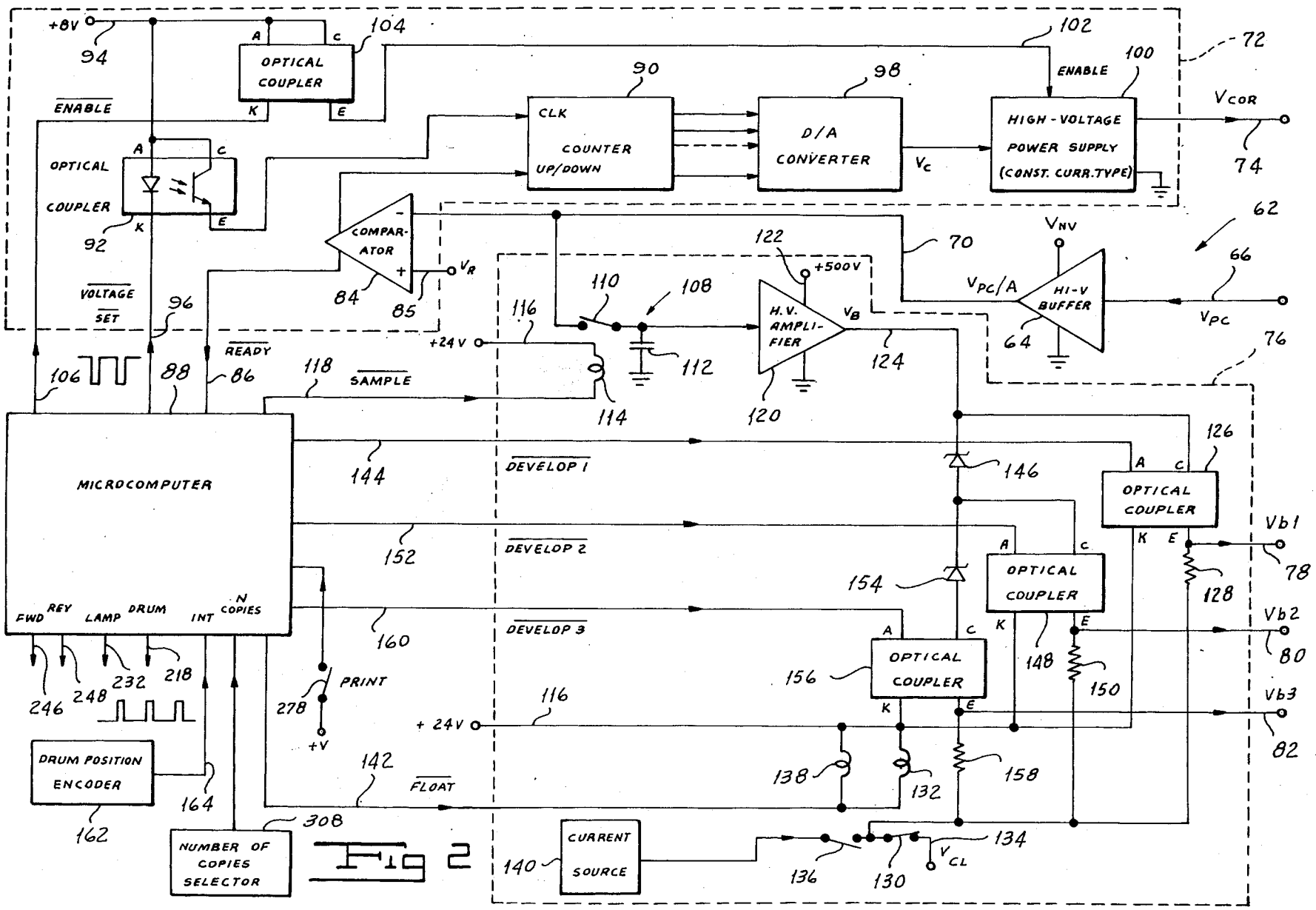
FIG. 2 is a schematic diagram of the control circuit of the copier shown in FIG. 1.

Referring now to FIG. 2, in the charge control circuit 72, a digital comparator 84 compares the potential Vpc/A supplied on line 70 by high-voltage buffer 64 with a reference potential Vr. Comparator 84 supplies a first output to a microcomputer 88 by way of a $\overline{\text{READY}}$ line 86, and provides a second output to the up/down control input of an up/down counter 90. An optical coupler 92 of the diode-transistor type has its anode and cathode terminals coupled respectively to an 8 volt line 94 and to a $\overline{\text{VOLTAGE SET}}$ line 96 originating from the computer 88. The collector and emitter output terminals of optical coupler 92 are connected respectively to the 8 volt line 94 and to the clock input to counter 90. Counter 90 supplies parallel outputs to a digital-to-analog converter (DAC) 98, which in turn supplies an analog output Vc to the control input of a high-voltage power supply 100. High-voltage supply 100, which is preferably of the constant-current type, supplies its output to the line 74 coupled to charge corona 20. A line 102 couples an enable input of high-voltage supply 100 to the emitter output terminal of an optical coupler 104, the collector output terminal of which is coupled to 8 volt line 94. Coupler 104 has its anode and cathode input terminals coupled respectively to line 94 and to an $\overline{\text{ENABLE}}$ line 106 originating from computer 88.

An interrupt input INT of microcomputer 88 is responsive to a drum position encoder 162 (not shown in FIG. 1), which provides pulses on a line 164 synchronously with the rotation of photoconductor drum 12. Computer 88 also receives an input (NCOPIES) from a user-actuated number-of-copies selector 308 of any suitable type known of the art, as well as from a print switch 278 which is momentarily closed by the user to initiate a copy cycle. Computer 88 provides outputs on line 218, line 232, and lines 246 and 248 to drum drive 216, lamp drive 230, and scanner drive 244, respectively.

Referring still to FIG. 2, in the bias control circuit 76, a sample-and-hold circuit indicated generally by the reference character 108 comprises a normally open switch 110 controlled by a relay coil 114. Coil 114 is coupled at one end to a 24 volt line 116 and at the other end to a $\overline{\text{SAMPLE}}$ line 118 originating from microcomputer 88. Coil 114, when energized by a low-level signal on line 118, closes switch 110 to couple buffer output line 70 to the input of a high-voltage amplifier 120 which is also coupled to ground through a storage capacitor 112. The power supply for amplifier 120 is derived from any suitable source, such as a 500 volt line 122. Amplifier 120 provides an output potential Vb on line 124. An optical coupler 126 similar to coupler 92 couples line 124 to the line 78 connected to the first development electrode 46. Optical coupler 126 has its anode and cathode input terminals coupled respectively to a $\overline{\text{DEVELOP 1}}$ line 144 originating from microcomputer 88 and to 24 volt line 116. A resistor 128 couples line 78 to the junction of a normally closed switch 130 and a normally open switch 136. Switches 130 and 136 are respectively controlled by relay coils 132 and 138 coupled between the 24 volt line 116 and a $\overline{\text{FLOAT}}$ line 142 originating from microcomputer 88.

Whenever $\overline{\text{FLOAT}}$ line 142 is at a high logic level, relay coils 132 and 138 remain unenergized, and switch 130 couples resistor 128 to a line 134 providing a negative cleaning potential Vcl. On the other hand, whenever line 142 is at a low logic level, both of relay coils 132 and 138 are energized so that switch 136 couples resistor 128 to a constant-current source 140. If desired, the current source 140 may be eliminated, in which case the constant current is simple zero. Thus, whenever optical coupler 126 is energized by a low-level $\overline{\text{DEVELOP 1}}$, line 78, coupled to the first development electrode 46, carries the potential Vb. If optical coupler 126 is unenergized, and relay coils 132 and 138 are also unenergized, line 78 carries the negative cleaning potential Vcl provided by line 134. On the other hand, if optical coupler 126 is unenergized while relay coils 132 and 138 are energized, line 78 floats at a potential determined in part by current source 140.

A zener diode 146 couples line 124 to the collector terminal of an optical coupler 148, the emitter output terminal of which is coupled to line 80, connected to the second development electrode 48. A resistor 150 couples line 80 to the junction of relay switches 136 and 130. The anode and cathode input terminals of optical coupler 148 are coupled respectively to a $\overline{\text{DEVELOP 2}}$ line 152 originating from microcomputer 88 and to the 24 volt line 116. Line 80 responds to the appearance of various potentials on lines 152 and 142 in the same manner that line 78 responds to potentials on lines 144 and 142. However, energization of optical coupler 148 supplies line 80 with a potential that is reduced from that appearing on line 78, owing to the drop across zener diode 146. Line 80 is supplied with a lower biasing potential than line 78 to compensate for the fact that, as toner particles deposit on the surface 14 of the drum 12, their opposite-polarity charge tends to neutralize the surface potential. A somewhat lower bias voltage is thus necessary for the system to operate in the desired manner.

A second zener diode 154 has its anode coupled to the collector terminal of an optical coupler 156 and its cathode coupled to the junction of zener diode 146 nd coupler 148. Optical coupler 156 has its emitter output terminal coupled to line 82, connected to the third development electrode 50, as well as through a resistor 158 to the junction of relay switches 130 and 136. Optical coupler 156 has its anode and cathode input terminals coupled respectively to a $\overline{\text{DEVELOP 2}}$ line 160 originating from microcomputer 88 and to the 24 volt line 116. Line 82 responds to the appearance of various potentials on lines 160 and 142 in a manner analogous to that of lines 78 and 80, except that the potential on line 82, when coupler 156 is energized, is reduced still further from the potential of line 80 by zener diode 154, for the reasons indicated above.

Figure 3:
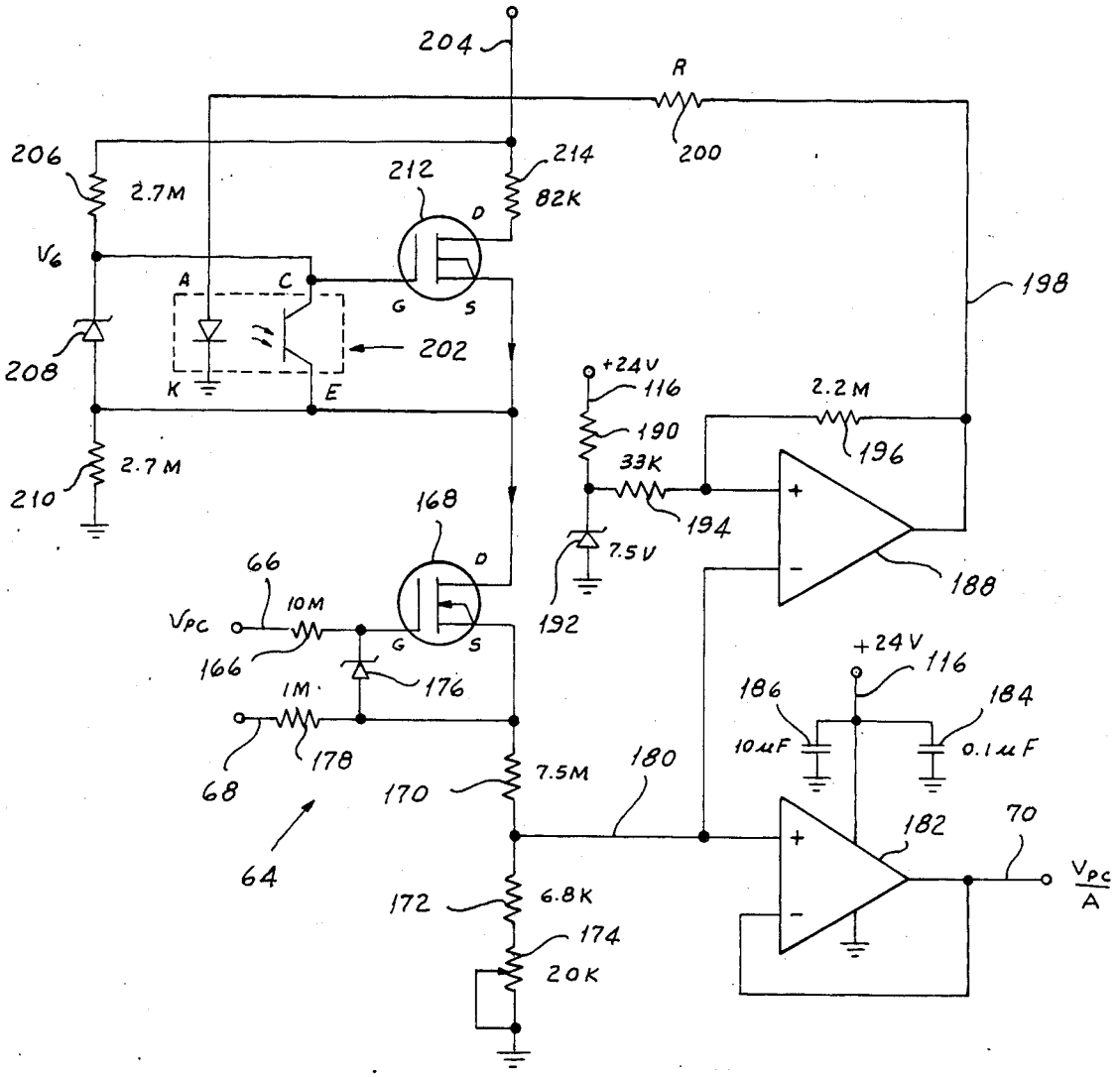
FIG. 3 is a schematic diagram of the high-voltage buffer of the control circuit shown in FIG. 2.

Referring now to FIG. 3, in the high-voltage buffer 64, a 10 megohm resistor 166 couples line 66 from sensor electrode 40 to the gate of a field-effect transistor (FET) 168. A 7.5 megohm resistor 170 couples the source terminal of FET 168 to one terminal of a 6.8 kilohm resistor 172. The other terminal of resistor 172 is coupled to a fixed contact of a 20 kilohm potentiometer 174, the movable contact of which is coupled to ground. A zener diode 176 coupled between the gate and source of FET 168 protects the transistor from any damage that might result from an abnormally large difference between the gate potential and the source potential. A one megohm resistor 178 couples the source of FET 168 to the line 68 coupled to guard electrodes 42 and 44. Line 68 provides guard electrodes 42 and 44 with a relatively low-impedance source of potential, isolating sensor electrode 40 from extraneous influences such as the potentials of development electrodes 46, 48 and 50.

A line 180 couples the junction of resistors 170 and 172 to the noninverting input of a first operational amplifier 182 as well as to the inverting input of a second operational amplifier 188. Amplifiers 182 and 188 receive their power supply from a suitable source such as 24 volt line 116. A 0.1 microfarad capacitor 184 and a 10 microfarad capacitor 186 are coupled in parallel between 24 volt line 116 and ground to filter out any extraneous signals from the line. The output of amplifier 182, which appears on line 70, is also fed back to the inverting input of the same amplifier so that the amplifier functions as a unity-gain impedance converter. It will be apparent from the foregoing description that amplifier 180 provides a signal Vpc/A on line 70, corresponding to the input signal Vpc on line 66 but reduced by an appropriate scale factor A.

A resistor 190 having one terminal coupled to the 24 volt line 116 has its other terminal coupled to the cathode of 7.5 volt zener diode 192, the anode of which is grounded. A 33 kilohm resistor 194 couples the cathode of zener diode 192 to the noninverting input of amplifier 188. A 2.2 megohm resistor 196 couples the output of amplifier 188 to the noninverting input. Amplifier 188 provides an output on line 198, which is coupled to the anode of an optical coupler 202, similiar to coupler 92, through a resistor 200.

A line 204 carrying a suitable high voltage DC potential is coupled to one terminal of a 2.7 megohm resistor 206, the other terminal of which is coupled to the cathode of a zener diode 208. A second 2.7 megohm resistor 210 couples the anode of zener diode 208 to ground. Zener diode 208 and the phototransistor of optical coupler 202 provide parallel paths between the gate and source of a second field-effect transistor (FET) 212. FET 212 has its drain coupled to high-voltage line 204 through an 82 kilohm resistor 214 and has its source coupled directly to the drain of FET 168.

Figure 4:
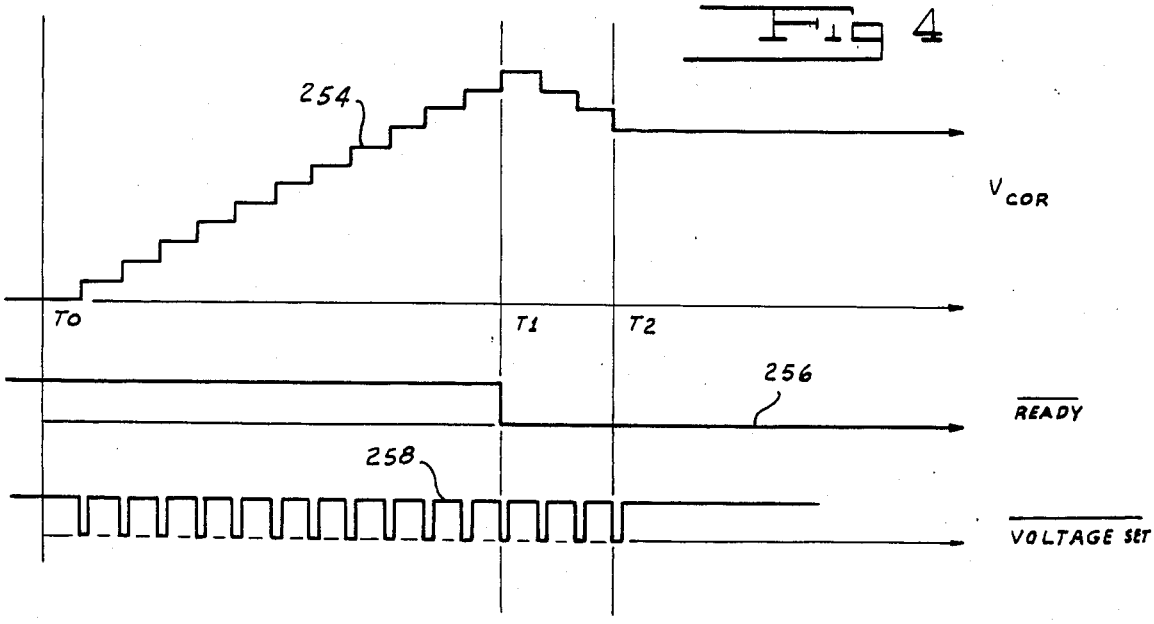
FIG. 4 is a plot of various signal levels as a function of time during the prescanning phase of the copy cycle.
Figure 6:
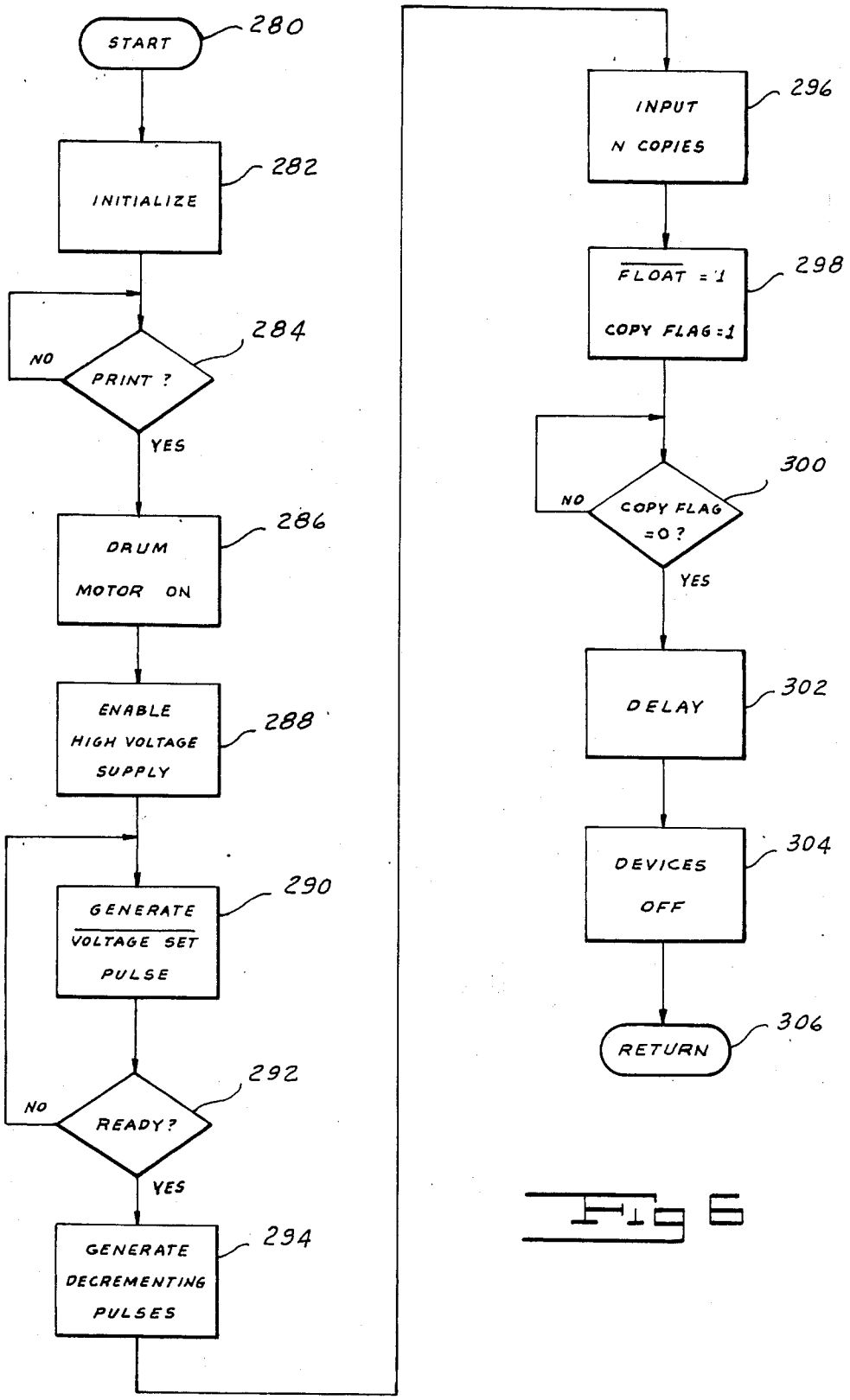
FIG. 6 is a flowchart of the sequence of normal operation of the control circuit shown in FIG. 2.

Referring now to FIGS. 4 and 6, upon beginning a copy cycle (step 280), microcomputer 88 first performs an initializing operation (step 282) in which $\overline{\text{ENABLE}}$, $\overline{\text{VOLTAGE SET}}$, $\overline{\text{SAMPLE}}$, $\overline{\text{DEVELOP 1}}$, $\overline{\text{DEVELOP 2}}$ and $\overline{\text{DEVELOP 3}}$ are set at 1, while $\overline{\text{FLOAT}}$ is set at 0. Microcomputer 88 at this time also sets an internal copy flag at 0, and resets an internal cycle counter (not separately shown) at 0. In addition, counter 90 is reset and all of the electrical devices controlled by the computer 88 are set in an off condition. Following the initializing step, the computer 88 enters a standby phase (step 284), in which it waits for an operator print command made by closing the switch 278 coupled to an input to the computer. Upon receiving such a print command, at time T0, computer 88 generates a DRUM signal on line 218 to rotate the photoconductor drum 12 (step 286), and generates a low-level $\overline{\text{ENABLE}}$ signal on line 106 to enable the high-voltage power supply 100 coupled to charge corona 20 (step 288).

Thereafter, the computer 88 enters a loop (steps 290 and 292) in which it generates a train 258 of regularly timed low-level $\overline{\text{VOLTAGE SET}}$ pulses on line 98 to increment periodically counter 90, and thus the rate at which corona 20 charges the adjacent portion of the photoconductor 14. As a result, the potential Vcor supplied to the corona 20 follows a rising staircase pattern 254 beginning at time T0 when the print command is received and occurring in synchronism with the $\overline{\text{VOLTAGE SET}}$ pulses generated by computer 88. At a time Tl the corona voltage Vcor will have risen to such a level that the output Vpc/A of high-voltage buffer 64 equals the reference potential Vr. When this occurs, the $\overline{\text{READY}}$ signal 256 provided on line 86 by comparator 84 changes from 1 to 0, so that counter 90 will count down in response to succeeding low-level $\overline{\text{VOLTAGE SET}}$ pulses on line 96. Upon receiving such a $\overline{\text{READY}}$ signal (step 292), computer 88 generates a predetermined number of additional $\overline{\text{VOLTAGE SET}}$ pulses to decrement counter 90 and thus the potential Vcor supplied on line 74 to charge corona 20. This decrementing is performed because, as shown in FIG. 1, the sensor electrode 40 is displaced from the charge corona 20 by an angle $\alpha$ with respect to the axis of the drum 12. Thus, by the time comparator 84 senses that the corona 20 is charging the photoconductive surface 14 to the proper level, the counter 90 has been further incremented by pulses on line 96. The subsequent decrementing operation performed by computer 88 (step 294) simply compensates for this inherent overcorrection. At a time T2, the decrementing pulses have restored the corona potential Vcor to the value that produced the $\overline{\text{READY}}$ signal from comparator 84.

Following this decrementing operation, the computer 88 interrogates selector 308, which is actuated by the operator to select the number of copies desired (step 296). Thereafter, referring to FIG. 5, computer 88 provides a high-level $\overline{\text{FLOAT}}$ signal 276 on line 142 to cause bias control circuit 76 to supply electrodes 46, 48 and 50 with a negative cleaning potential. At the same time. computer 88 sets the copy flag to 1 (step 298).

The scanning portion of the copy cycle is controlled in response to interrupt inputs received from position encoder 162 in synchronism with the rotation of the drum 12, in a manner to be described below. Following the completion of the scanning portion of the copy cycle, the copy flag is set to 0. When the computer 88 senses that the copy flag has been reset (step 300), the computer waits a predetermined interval (step 302), and shuts off the electrical devices (step 304) before returning (step 306) to the beginning of the main routine (step 280) in preparation for another copy cycle.

Figure 5:
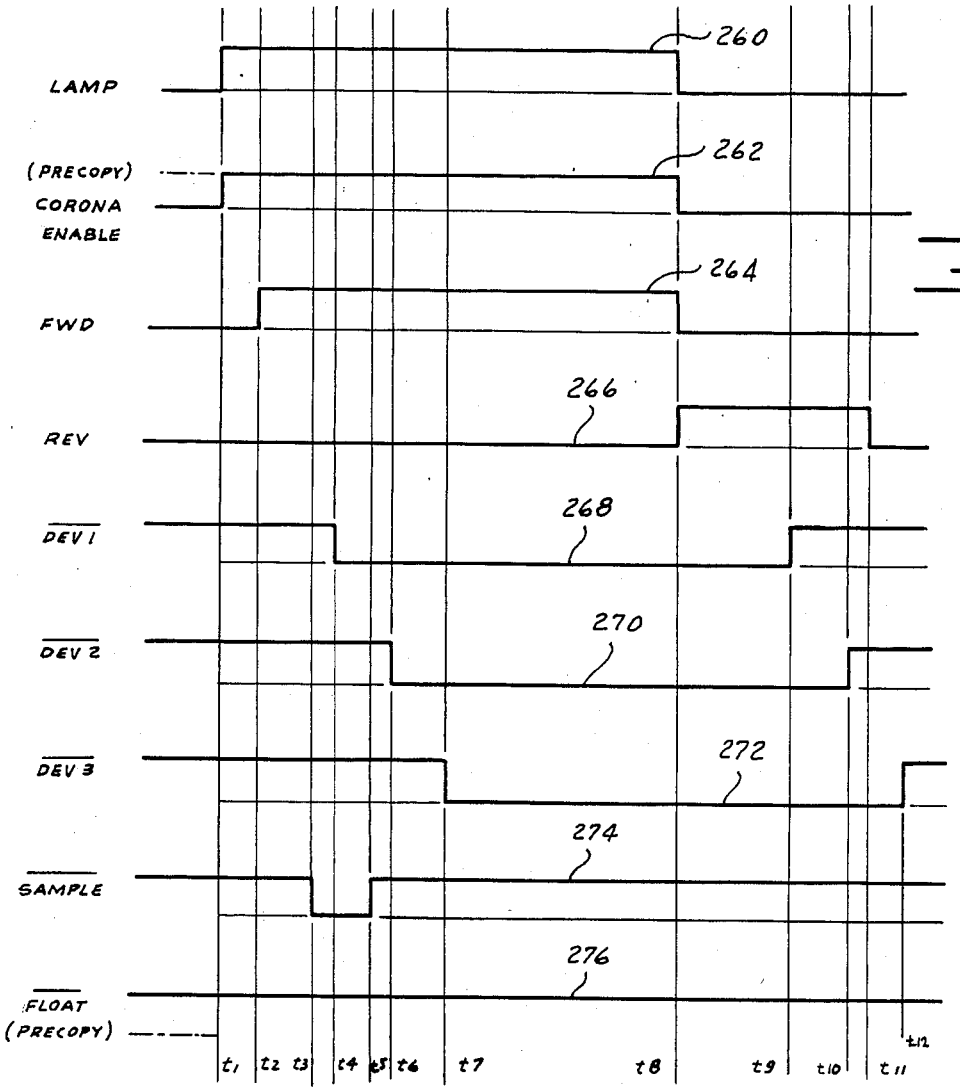
FIG. 5 is a plot of various signal levels as a function of time during the scanning phase of the copy cycle.
Figure 7:
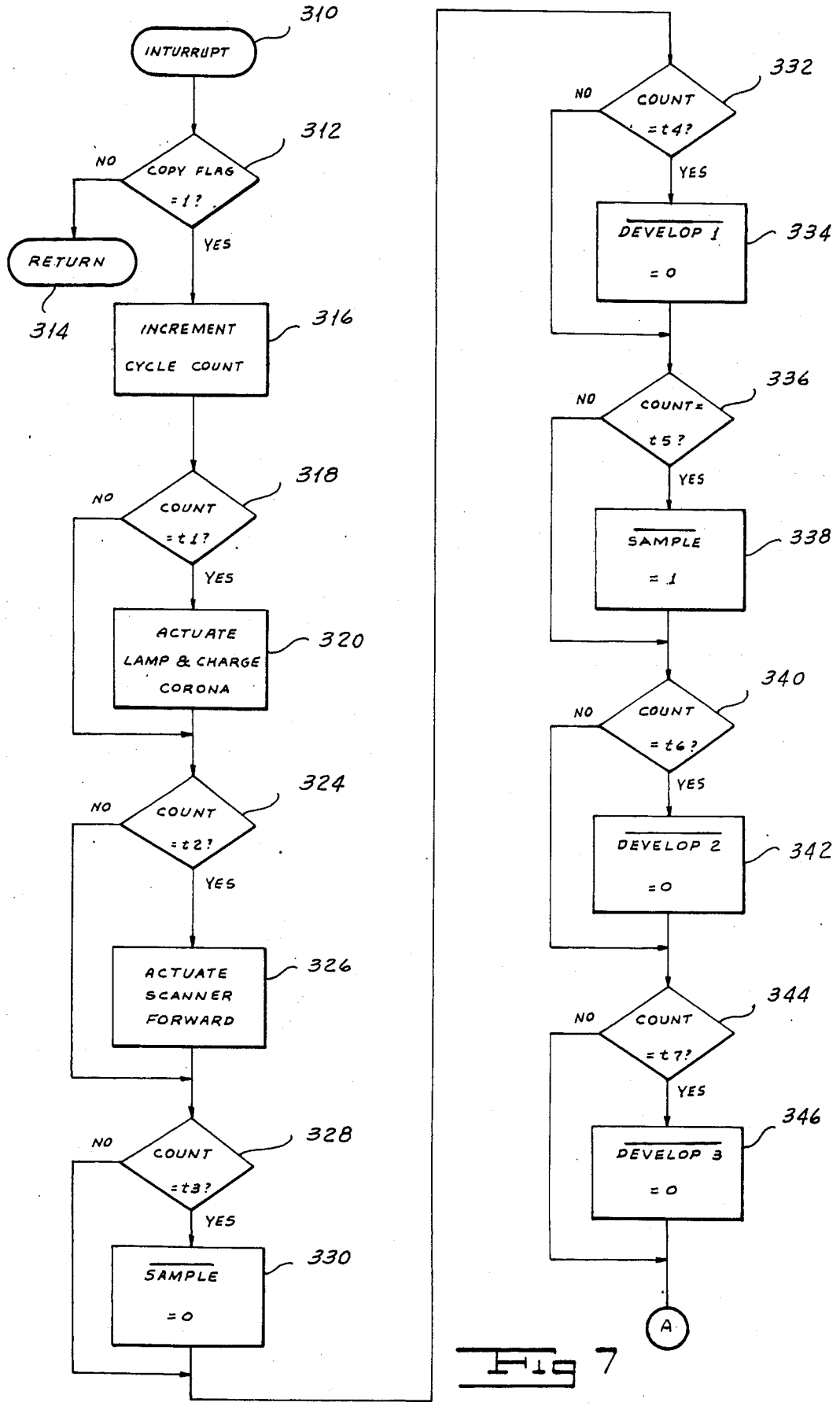
FIGS. 7 and 8 are a flowchart of the sequence of operation of the control circuit shown in FIG. 2 in response to an interrupt input.
Figure 8:
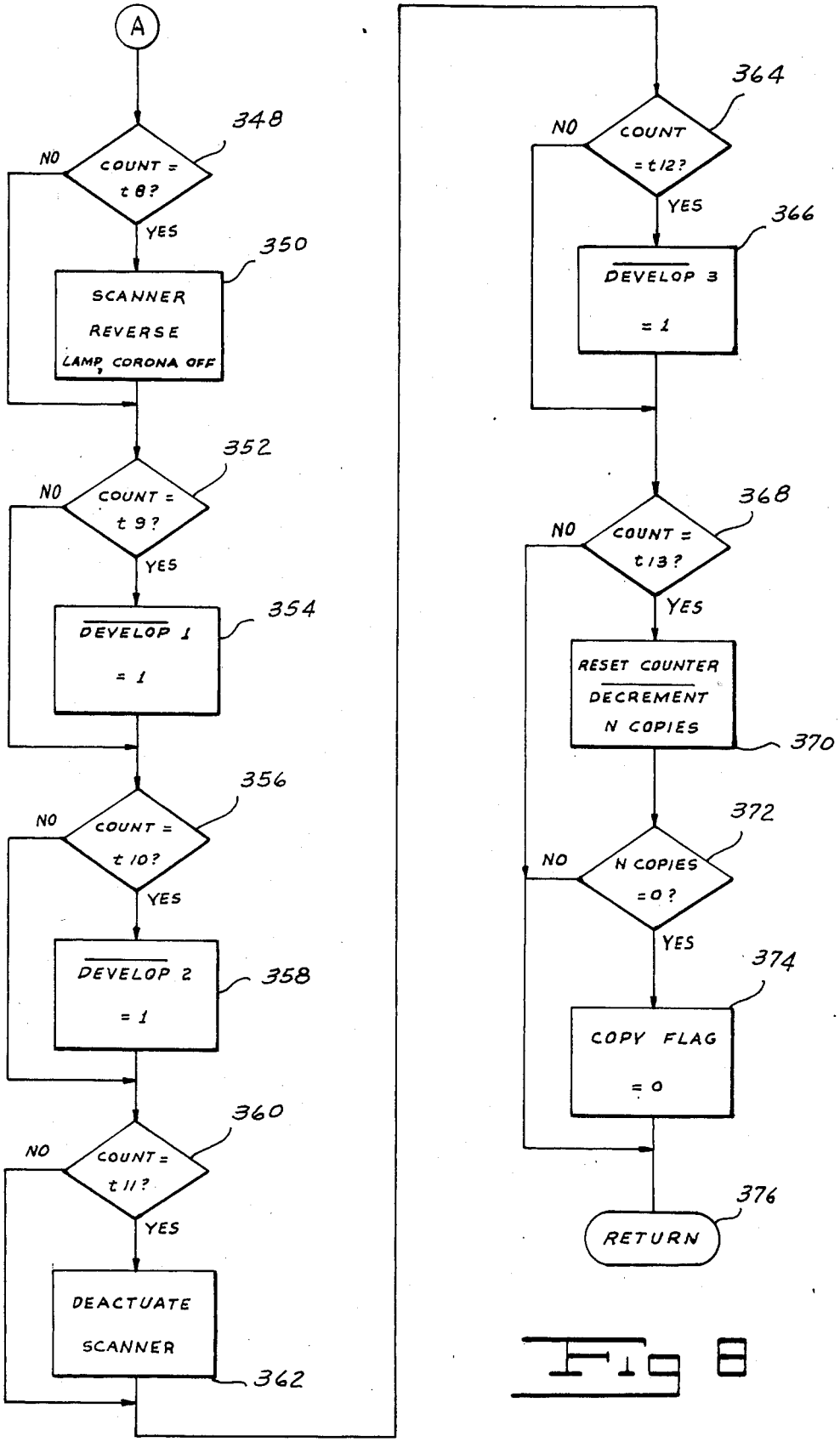

FIGS. 7 and 8 show the interrupt routine executed by computer 88 in response to successive pulses from drum position encoder 162. Referring also to FIG. 6, upon entering the interrupt routine (step 310), the computer 88 checks the internal copy flag to determine whether it has been set at 1, indicating that the scanning phase of the copy cycle is taking place (step 312). If the copy flag has not been set at 1, the computer exits from the interrupt routine (step 314) and returns to the main routine at the point of interruption. If the copy flag has been set at 1, the computer increments an internal counter (not separately shown) used to time the scanning cycle (step 316). The computer then interrogates the internal cycle counter to determine what operations, if any, are to be performed on this pass through the interrupt routine. Referring now also to FIG. 5, if the counter has reached a count of t1 (step 318), the computer 88 provides appropriate signals 260 and 262 (FIG. 6) on lines 232 and 106 to actuate the exposure lamp 228 and charge corona 20 (step 320). When, on a subsequent pass through the interrupt routine, the count reaches t2 (step 324), the computer 88 supplies a signal 264 on line 246 to scanner drive 244 to initiate the forward scanning stroke of scanner carriages 226 and 238 (step 326).

By the time that the internal counter reaches a count of t3 (step 328), the photoconductor 14 has rotated to such an extent that the leading portion of the latent image is adjacent sensor electrode 40. At this point, computer 88 applies a low-level signal 274 on $\overline{\text{SAMPLE}}$ line 118 to supply amplifier 120 with the output of buffer 64 (step 330). At a count of t4 (step 332), the latent image has advanced to a position just downstream of the first development electrode 46. The computer 88 then provides a low-level signal 268 on $\overline{\text{DEVELOP 1}}$ line 144 to cause coupler 126 to supply line 78 with a positive bias potential. Preferably, amplifier 120 so adjusted as to provide a bias potential on line 78 which is higher than the sensed potential Vpc of the photoconductor surface 14 by a predetermined amount, such as 80 volts. At a count t5 in the copy cycle, the leading edge of the latent image on the photoconductor surface 14 has advanced slightly past the sensor electrode 40 (step 336). The computer then reapplies a high-level signal to the sample-and-hold circuit 108 to hold the signal level being instantaneously applied to amplifier 120 (step 338).

At a still later point in the copy cycle, when the counter reaches a count of t6 (step 340), the leading edge of the latent image has advanced to a point just downstream of the second development electrode 48 (step 340). At this point, the computer 88 provides a low-level signal 270 on $\overline{\text{DEVELOP 2}}$ line 152 to cause coupler 148 to supply line 80 to electrode 48 with a positive bias potential (step 342). At a still later point in the scanning cycle, when the counter reaches a count of t7 (step 344), the computer 88 supplies a low-level signal 272 on line 160 to cause coupler 156 to supply development electrode 50 with a positive bias potential on line 82 (step 346).

When the computer 88 senses a count of t8 (step 348) the scanner carriages 326 and 328 have advanced to the end-of-scan positions 226' and 238' shown in phantom lines in FIG. 1. At this point, computer 88 supplies a high-level signal 266 on line 248 to reverse the movement of scanner carriages 226 and 238, and provides suitable signals on lines 232 and 106 to deactuate the exposure lamp 28 and charge corona 20 (step 350).

When the cycle counter reaches a count of t9 (step 352), the trailing edge of the latent image on photoconductor 14 has just cleared the first development electrode 46. When this happens, computer 88 reapplies a high-level signal to line 144 (step 354). As a result, line 78 now supplies electrode 46 with a negative cleaning potential from line 134. Shortly thereafter, upon a count of t10 (step 356), the trailing edge of the image on the surface 46 has cleared the second development electrode 48. The computer 88 then applies a high-level signal on line 152 to cause line 80 to apply a similar cleaning potential from line 134 to the second development electrode 48 (step 358). At a later point, when the timer reaches a count of tll (step 360), the scanning carriages 226 and 238 have returned to their original positions shown in solid lines in FIG. 1. At this point, computer 88 deactuates scanner drive 216 (step 362). At a count of t12 (step 364), the trailing edge of the image on the photoconductor 14 has cleared the third development electrode 50. When this occurs, computer 88 supplies line 160 with a high-level signal to cause line 82 to supply the third development electrode 50 with a negative cleaning potential on line 134 (step 366).

When the counter reaches a count of t13 at the end of a given scanning cycle (step 368), the computer 88 resets the internal counter and decrements by one the number of copies remaining to be made (step 370). The computer 88 then determines whether there are any copies remaining to be made (step 372). If there are remaining copies to be made, the computer simply exits from the interrupt routine at this point (step 376). If no more copies remain to be made, the computer resets the copy flag to 0 (step 374) before exiting from the interrupt routine. By resetting the copy flag, the computer 88 inhibits the further execution of the interrupt routine (step 312) and indicates to the main routine (step 300) that the copy cycle is about to be completed.

While I have disclosed the use of a general-purpose microcomputer, programmed in a particular manner, to regulate the disclosed system, suitable alternative programs or components will be readily apparent to those skilled in the art. For example, special-purpose digital logic could be used instead of the microcomputer, or the cycle timing could be accomplished in a manner not involving the use of interrupt inputs.

It will be seen that I have accomplished the objects of my invention. By using the same sensing electrode to measure, at different instants of time, the potential of unexposed and fully exposed portions of the photoconductor surface, I can control both the charging and bias potentials of an electrophotographic copier without undue complexity or expense. By charging the photoconductor at a progressively increasing rate at the beginning of the copy cycle, I further simplify the control circuit. By sensing the potential of the photoconductor through a layer of slightly conductive liquid rather than through air, I reduce or eliminate measurement inaccuracies. Finally, by staggering the control cycles of the developing electrodes, I maximize the period between scans for cleaning the electrodes for a given copy rate.

It will be understood that certain features and subcombinations are of utility and may be employed without reference to other features and subcombinations. This is contemplated by and is within the scope of my claims. It is further obvious that various changes may be made in details within the scope of claims without departing from the spirit of my invention. It is, therefore, to be understood that my invention is not to be limited to the specific details shown and described.

Having thus described my invention, what I claim is:

1. Apparatus including in combination a photoconductor having a surface adapted to bear an electrostatic charge, means for electrostatically charging said surface of said photoconductor, means for exposing a portion of said charged surface to a pattern of light and shade to form an electrostatic latent image while leaving a portion of said charged surface unexposed, means including a developing electrode for developing said latent image, means for biasing said developing electrode, means for moving said photoconductor along a path successively past said charging means, said exposing means, and said developing electrode, means disposed along said path between said exposing means and said developing electrode for sensing the potential of said charged surface, first means for sampling said sensing means during the movement of said unexposed portion of said charged surface past said sensing means, means responsive to said first sampling means for controlling said charging means, second means for sampling said sensing means during the movement of said exposed portion of said surface past said sensing means, and means responsive to said second sampling means for controlling the said biasing means.

2. Apparatus as in claim 1 in which said sensing means comprises a sensing electrode, said sensing electrode and said developing electrode being positioned adjacent to said photoconductor with respective spaces between said electrodes and said photoconductor, said developing means including means for supplying developer liquid to said spaces.

3. Apparatus including in combination a photoconductor having a surface adapted to bear an electrostatic charge, means for electrostatically charging said surface of said photoconductor, means for exposing said charged surface to a pattern of light shade to form an electrostatic latent image, means for applying a developer liquid to said latent image to develop said image a sensing electrode positioned adjacent to said photoconductor with a space therebetween, said electrode being so positioned relative to said developing means that said liquid fills said space, and means responsive to said electrode for controlling said charging means.

4. Apparatus as in claim 3 in which said developing means includes a developing electrode and in which said photoconductor is moved along a path successively past said charging means, said exposing means, and said developing electrode, said sensing electrode being disposed along said path between said exposing means and said developing electrode.

5. Apparatus as in claim 3, in which said developing means includes a developing electrode, said apparatus including means for biasing said developing electrode and means responsive to said sensing electrode for controlling said biasing means.

6. Apparatus including in combination a photoconductor having a surface adapted to bear an electrostatic charge, means for moving said photoconductor along a path, means disposed at a first location along said path for charging said surface of said photoconductor at a controllable rate, means for progressively changing said rate, means disposed at a second location along said path downstream from said first location for sensing the surface potential of said photoconductor, and means responsive to said sensing means for inhibiting said rate-changing means.

7. Apparatus as in claim 6 in which said ratechanging means increases said rate.

8. Apparatus as in claim 6 in which said ratechanging means increases said rate from zero.

9. Apparatus as in claim 6 in which said inhibiting means includes means for comparing said surface potential with a reference potential and means responsive to said sensing means for inhibiting said rate-changing means.

10. Apparatus including in combination a photoconductor having a surface adapted to bear an electrostatic charge, means for moving said photoconductor along a path at a predetermined speed, means disposed at a first location along said path for charging said surface of said photoconductor at a controllable rate, means for storing a count, means for periodically incrementing said count, means responsive to said count for controlling said charging rate, means disposed at a second location along said path downstream from said location for sensing the surface potential of said photoconductor, means for comparing said surface potential with a reference potential, and means responsive to said comparing means for inhibiting said incrementing means.

11. Apparatus as in claim 10 in which said incrementing means increments said count by a predetermined amount in the period of time required for said photoconductor to move from said first location to said second location, including means responsive to said, comparing means for decrementing said count by said predetermined amount.

12. Apparatus including in combination a photoconductor having a surface adapted to bear an electrostatic charge, means for moving said photoconductor along a path, means for charging said surface of said photoconductor, means for exposing said charged surface to an optical image of an original to form an electrostatic latent image, means including a plurality of development electrodes for developing said latent image, said electrodes being disposed at respective locations spaced along said path, means for supplying said development electrodes with a potential of a first polarity, means for providing a potential opposite in polarity to said first polarity, and means for supplying said electrodes with said opposite-polarity potential over predetermined respective time intervals staggered in accordance with the respective displacements of said electrodes along said path.

* * * * *